United States Patent [19]

Rejc

[11] Patent Number: 4,574,862

[45] Date of Patent: Mar. 11, 1986

[54] FOLDING GATE

[75] Inventor: Gabriel Rejc, Moosburg, Fed. Rep. of Germany

[73] Assignee: EFAFLEX Transport-und Lager Technik GmbH, Bruckberg-Edlkofen, Fed. Rep. of Germany

[21] Appl. No.: 486,911

[22] Filed: Apr. 20, 1983

[30] Foreign Application Priority Data

Apr. 21, 1982 [DE] Fed. Rep. of Germany ... 8211456[U]

[51] Int. Cl.[4] ..... E05D 15/26

[52] U.S. Cl. ..... 160/199; 160/206

[58] Field of Search ..... 160/206, 354, 332, 199, 160/220, 229 R, 229 B, 133; 16/367

[56] References Cited

U.S. PATENT DOCUMENTS

| | | | |
|---|---|---|---|
| Re. 14,893 | 5/1918 | Piper | 160/199 |
| 1,069,505 | 8/1913 | Wheatley | 16/367 |
| 1,420,087 | 6/1922 | Frantz | 160/199 |
| 1,581,854 | 4/1926 | May | 160/199 X |
| 1,986,178 | 1/1935 | Ainsworth | 160/199 |
| 2,538,429 | 1/1951 | Schantz | 160/206 |
| 2,839,135 | 6/1958 | Anderson | 160/133 |
| 3,003,551 | 10/1961 | Ferris | 160/220 X |
| 3,040,806 | 6/1962 | Merrill et al. | 160/199 |
| 3,229,751 | 1/1966 | Moorer | 160/199 X |
| 3,272,257 | 9/1966 | Dirubbo | 160/354 |
| 3,516,473 | 6/1970 | Rosenquist | 160/183 |
| 4,427,049 | 1/1984 | Belanger et al. | 160/332 X |

FOREIGN PATENT DOCUMENTS 856949 12/1960 United Kingdom .

*Primary Examiner*—Ramon S. Britts
*Assistant Examiner*—David M. Purol

[57] ABSTRACT

A folding gate comprises two rectangular segments connected for articulation by hinges, said first segment being supported directly by a gate wing bearing. Said second segment includes a panel and a carrier structure to support the weight of the panel, said carrier structure comprises a pivot arm which is disposed at the upper edge of the second segment and from which the panel is suspended, wherein the pivot arm is connected by its one end to a carrier structure of the first segment in articulated fashion such that the pivot arm is movable not only about a vertical axis but to a limited extent also about a horizontal axis with respect to the first segment, and wherein the other end of the pivot arm is guided horizontally and supported vertically at a glide track arrangement by means of a guide roller. By this structure any impact hitting the panel of the second segment practically is not transmitted to the first segment. The weight of the second segment is carried approximately evenly by the glide track arrangement and by the first segment.

12 Claims, 4 Drawing Figures

FOLDING GATE

FIELD OF THE INVENTION

The invention relates to a folding gate, comprising at least one gate wing which is pivotable about a vertical axis in a gate wing bearing and a substantially straight glide track arrangement at the upper limitation of the gate opening, the gate wing comprising two rectangular segments connected for articulation by hinges, of which the first segment is supported directly in the gate wing bearing, while the second segment carries a guide roller at the end of its upper edge remote from the first segment, said guide roller being guided horizontally by the glide track arrangement, and each segment including a panel and a carrier structure to support the weight of the panel and hold the segment in associated bearings.

BACKGROUND OF THE INVENTION

Such a folding gate is known. It is used above all in factories and for warehouses and has the advantage that it is suitable for closing relatively wide gate openings. The space needed for opening the gate wings of which, in general, two are provided, is relatively small as is the space requirement for the open door wings. Upon opening, each door wing is folded so that its segments abut each other. Normally the opening is effected by an opening device which will open the door wings mechanically and is controlled, for instance, by a light barrier responding to the approach of a vehicle to the folding gate.

With the known gate the carrier structures of the individual segments are embodied by stiff frames which also have portions along the edges of the two segments facing each other. Between these portions of the carrier structure there are several hinges which are distributed across the height of the folding gate and establish an articulated connection between the first and second segments and, moreover, carry the entire weight of the second segment, introducing the same into the carrier structure of the first segment. The guide roller running along the glide track arrangement is supported only in a horizontal plane along the glide track arrangement and assures that the end of the upper edge of the second segment remote from the first segment will follow the desired path determined by the glide track arrangement when opening and closing the gate.

It may happen from time to time in operation that one or more segments of the gate wings receive strong shocks, for example, when the opening device does not open the folding gate quickly enough and a vehicle used for hauling drives against the folding gate which has opened only incompletely. In such an event frequently not only the segment panel hit but also the carrier structure of the corresponding segment is damaged. Besides, often the first segment is damaged also if only the second segment has directly received the shock. Such damages cause considerable expenses for repair.

SUMMARY OF THE INVENTION

It is an object of the instant invention to design a folding gate of the kind specified initially such that the expenditure for repair in case of shocks against the folding gate is reduced.

This object is met, in accordance with the invention in that the carrier structure of the second segment comprises a pivot arm which is disposed at the upper edge of the second segment and from which the panel of the second segment is suspended, the pivot arm is connected by its one end to the carrier structure of the first segment in articulated fashion such that the pivot arm is movable not only about a vertical axis but to a limited extent also about a horizontal axis with respect to the first segment, and the other end of the pivot arm carrying the guide roller is supported also vertically at the glide track arrangement.

With the folding gate according to the invention the panel of the second segment is suspended from the pivot arm which is located at the upper edge of the second segment, the carrier structure of the second segment preferably consisting exclusively of the pivot arm. By this design in accordance with the invention a carrying connection between the two segments along their edges facing each other and substantially also over their entire height may be dispensed with so that any impact hitting the panel of the second segment practically is not transmitted to the first segment which, therefore, cannot be damaged by the same. In accordance with the design of the invention, furthermore, the weight of the second segment is carried approximately evenly by the glide track arrangement and by the first segment. In comparison with the known folding gate with which the first segment or its carrier structure has to support the entire weight of the second segment, therefore, the loading of the first segment by the second segment is reduced with the folding gate according to the invention. With the folding gate according to the invention it is provided that the pivot arm can move not only about a vertical axis but, to a limited extent, also about a horizontal axis with respect to the first segment. This means that the pivot arm may be suspended freely at both ends between the two supports and that any static redundancy in determination is avoided which would require greater dimensions of the carrier structure of the first segment. This provision will avoid the entire weight of the second segment from being introduced into the articulated connection between the pivot arm and the carrier structure of the first segment when the tolerances are unfavorable or alignment errors have occurred and in spite of having the pivot arm supported at its other end at the glide track arrangement.

The fact that the panel of the second segment is suspended from the pivot arm of the folding gate according to the invention does not exclude a direct connection between the panel of the second segment and the first segment, provided this connection is not of a kind which is suitable to transmit greater vertical and/or horizontal forces but instead only, for instance, flexible sealing boots of weatherstripping destined to seal the gap between the two segments.

It may be provided in an advantageous modification of the invention that the carrier structure of the first segment comprises a rigid L-shaped frame having one leg extending vertically along or parallel to the axis of the bearing of the gate wing, while the other leg extends horizontally along the upper edge of the first segment and is connected at its free end in articulated fashion to the one end of the pivot arm.

With this embodiment the carrier structures of the gate wing are disposed exclusively along the edges of the gate opening, thus being disposed in an area in which there is the least risk that they will be hit directly. Furthermore, the distance is the greatest from the area of the folding gate most frequently hit which is the area at the bottom near the free edge of the second segment.

Specifically in combination with this L-shaped frame as the carrier structure of the first segment the introduction of approximately half of the weight of the second segment into the glide track arrangement and the resulting partial discharging of the first segment of the weight of the second segment is of particular advantage because the horizontal leg thus may be of corresponding weaker design.

In another advantageous development of the invention it may be provided that the segment panels are webs of flexible material, the most suitable material being soft polyvinylchloride or rubber. Yet the panels also may be composed of two stiff boards disposed one on top of the other, each lower board being suspended from the corresponding upper board. In this case too the principle is observed that, at least with the second segment, the panel is carried by the pivot arm and there is no supporting connection between the two edges of the first and second segments facing each other. Because of the rigid design of the boards, however, it is possible, at the same time, to use the folding gate as an outside gate which can be locked. The design of the segment panels as individual rigid boards which are merely suspended rather than being inserted in a rigid frame enclosing them all around, has the advantage that only a single board need be replaced after the customary damage, whereas the other boards and the carrier structures remain undamaged and need not be repaired.

Further advantageous modifications of the invention are characterized in the sub-claims.

BRIEF DESCRIPTION OF THE DRAWING

In order that the invention may be clearly understood and readily carried into effect several embodiments will now be described, by way of example, with reference to the accompanying drawings, in which.

DESCRIPTION OF THE PREFERRED EMBODIMENTS

Figure 1:
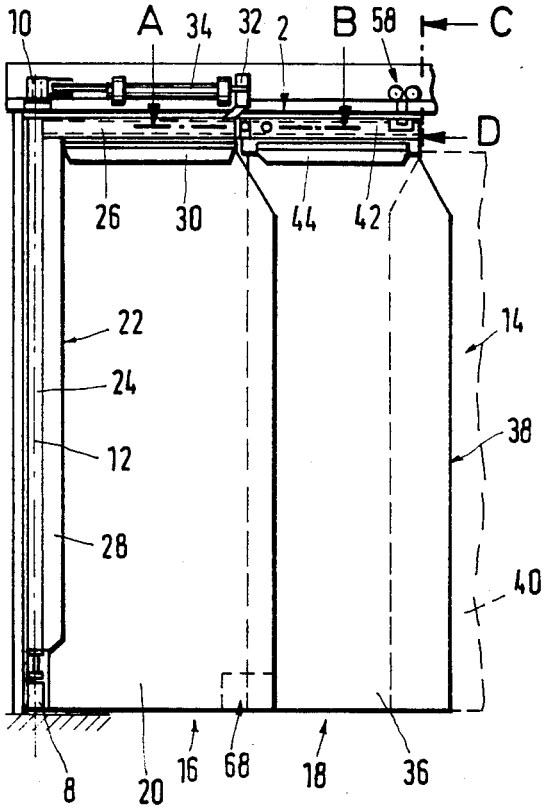
FIG. 1 is a front elevational view of a first embodiment of a folding gate according to the invention, showing only the left half.
Figure 2:
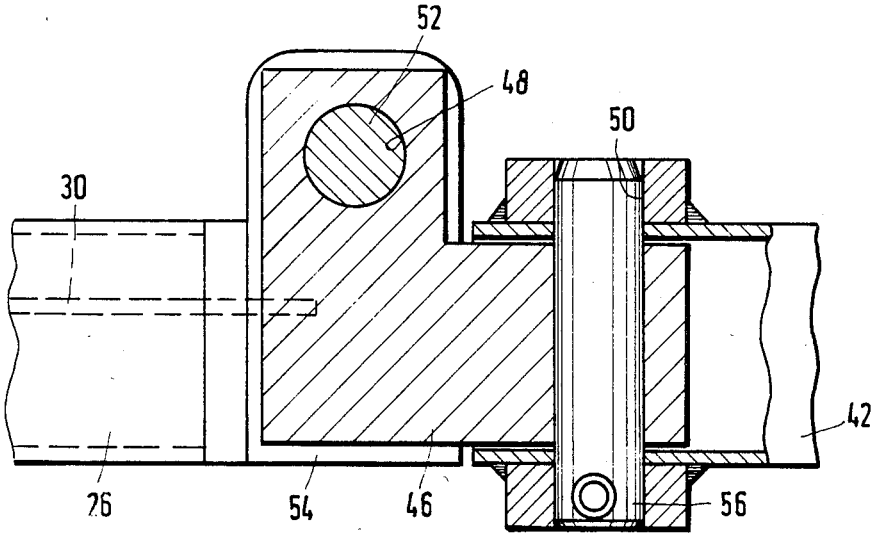
FIG. 2 is an enlarged cross sectional view along line A-B in FIG. 1.
Figure 3:
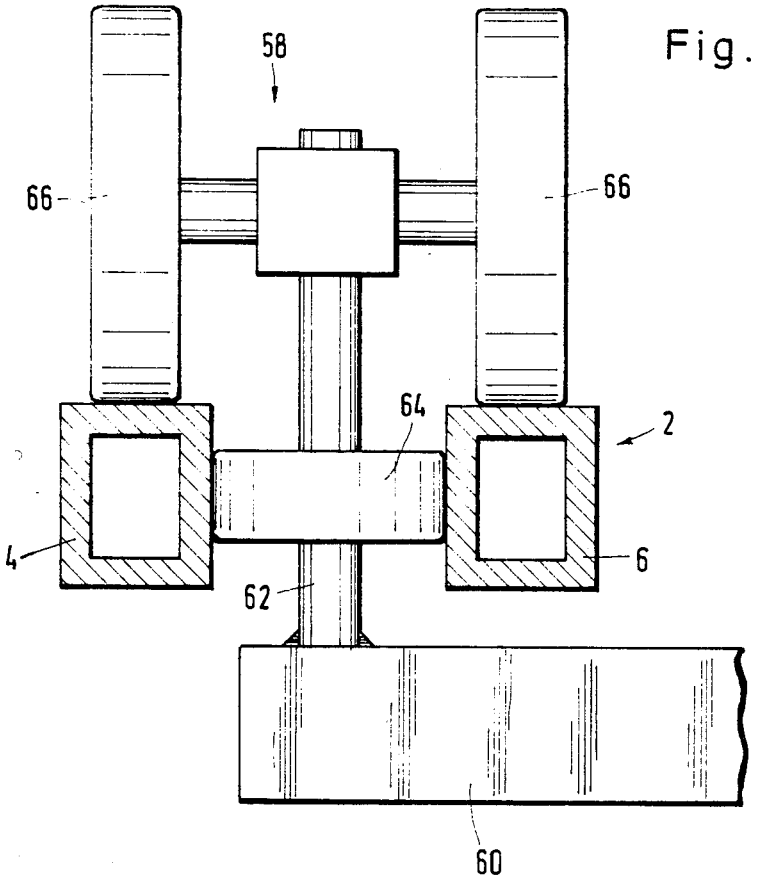
FIG. 3 is an enlarged cross sectional view along line C-D in FIG. 1.

First the folding gate will be described as shown in FIGS. 1, 2, and 3. The folding gate shown is located in or in front of a gate opening (not shown) along the upper limit of which a glide track arrangement 2 is fixed which consists substantially of two parallel straight horizontal glide tracks 4 and 6, as shown in FIG. 3. At the left edge of the gate opening, as seen in FIG. 1, there is a gate wing bearing consisting of a lower pin bearing 8 and an upper pin bearing 10 which together define a vertical axis 12 about which a gate wing, generally designated 14, may be pivoted. In its closed condition shown, this door wing closes one half of the gate opening.

The gate wing 14 consists of a first segment 16 shown at the left in FIG. 1 and of a second segment 18 shown at the right in FIG. 1. Both segments 16 and 18 have an outline which is substantially rectangular. The first segment 16 includes a panel 20 in the form of a web of an elastic, flexible material, for instance, soft polyvinylchloride which practically extends across the entire height and width of the first segment 16. The first segment 16 further comprises a carrier structure in the form of an L-shaped frame 22 consisting of a vertical leg 24 and a horizontal leg 26 firmly connected to the vertical leg 24 at the upper end thereof and extending to the right, as seen in FIG. 1, from the vertical leg 24. The vertical leg 24 is supported at both ends for rotation in bearings 8 and 10. A bar each 28 and 30, respectively, is fixed, for example, by welding to the inner sides of the two legs 24 and 26. The two bars 28 and 30 serve for fixing of the panel 20, for example, by means of some screws (not shown) at the left and upper edges, as seen in FIG. 1, of the panel 20.

It is obvious that the carrier structure of the first segment consisting of the frame 22 extends exclusively along the left and upper edges, as seen in FIG. 1, of segment 16 and has no elements at the lower and right edges of segment 16. The carrier structure of the first segment 16 thus extends exclusively along the edge of the gate opening (not shown) i.e. in an area which practically does not receive any direct impact in operation.

At the right end, as seen in FIG. 1, of the horizontal leg 26 there is a pin 32 which is engaged by an opening device for the folding gate, of which device FIG. 1 only shows a pneumatic cylinder 34 which either pivots the first segment 16 into the closing position shown or out of this position into an open position (not shown), depending on the pressurization. The specific design of the opening device, however, is not important to understand the invention. The second segment 18 of the gate wing 14 comprises a panel 36 which is made of flexible, elastic material, like the panel 20, and extends practically across the entire height and width of the second segment 18. It is obvious that the panels 20 and 36 overlap in the area of their edges facing each other and that the right edge 38, as seen in FIG. 1, of panel 36 extends such that it overlaps the corresponding panel 40 of the right gate wing (not specifically shown) when the folding gate is closed.

Apart from the panel 36 the second segment 18 also comprises a carrier structure in the form of a rigid and substantially straight pivot arm 42 which may be made, for instance, of sectional tubing. The pivot arm 42 extends along the upper edge of the second segment 18 and thus of the panel 36 which is fixed to the pivot arm 42 by means of a bar 44 welded to the remainder of the pivot arm 42. The connection between the bar 44 and the panel 36 is affected by a plurality of screws (not shown). The entire weight of the panel 36 is carried by pivot arm 42 from which alone the panel 36 is suspended. Thus no further carrier structure portions along the two lateral edges or along the lower edge of segment 18 are required to support the panel 36. The design described of the panel 36 and of the pivot arm 42 as well as the connection described between the pivot arm and the panel provide for an articulated suspension of the panel from the pivot arm 42 because the elasticity and flexibility of the material of which the panel 36 is made permits the panel to swing to the front and rear. This will cause slight bending of the area near the bar 44 without, however, introducing any significant force onto the pivot arm 42.

At its left end, as seen in FIG. 1, the pivot arm 42 is connected in articulated fashion to the free end of the horizontal leg 26. The design of this articulated joint is shown in detail in FIG. 2. An intermediate piece 46 formed with two bearing bores 48 and 50 is disposed between the leg 26 and the pivot arm 42. A bearing pin 52 having its axis extend in vertical direction to define the pivot axis between the first and second segments 16 and 18 is inserted in the bearing bore 48. At its upper and lower ends bearing pin 52 is fixed in fishplates 54 of which only the lower fishplate 54 is shown in FIG. 2, the fishplates in turn being secured to the free end of leg 26. This design permits the intermediate piece 46 to pivot in a horizontal plane about the bearing pin 52 and thus with respect to the leg 26. The other bearing bore 50 has a horizontal axis extending at a certain spacing from the axis of the bearing bore 48. A bearing pin 56 being secured at both ends to the left end, as seen in FIGS. 1 and 2, of pivot arm 42 is inserted into the bearing bore 50, permitting pivot arm 42 to pivot in a vertical plane with respect to the intermediate piece 46. The articulated joint described above thus is of a kind which will permit the pivot arm 42 to move not only about a vertical axis, namely the axis of bearing pin 52 but also about a horizontal axis, namely the axis of bearing pin 56 with respect to leg 26 and thus in relationship to frame 22.

At its right end, as seen in FIG. 1, pivot arm 42 is suspended from a carriage 58, as shown in greater detail in FIG. 3. A short transverse bar 60 extending vertically to the plane of the drawing extends from the right end, as seen in FIG. 1, of pivot arm 42. A vertically extending bar 62 is fixed to the free end of this arm. A guide roller 64 is supported for rotation on bar 62 at the level of the two glide tracks 4 and 6 which guide the guide roller in a horizontal plane so that the guide roller 64 can follow only the straight path defined by the glide track arrangement 2. This at the same time fixes the path of movement of the right edge, as seen in FIG. 1, of the second segment 18 when opening and closing the folding gate. At its upper end bar 62 is suspended in articulated fashion from the carriage 58 by a suitable joint (not shown in detail) such that the bar 62 is pivotable within certain limits toward all sides with respect to the carriage 58. However, the connection between bar 62 and carriage 58 is of such kind that it can introduce vertical forces from the transverse arm 60 and thus from the pivot arm 42 into the carriage 58 which transmits the same by way of rollers 66 adapted to run on the upper sides of glide tracks 4 and 6 into the glide tracks and thus into the glide track arrangement 2.

Thus pivot arm 42 is suspended at both ends in the manner described above, namely at the glide track arrangement 2 by means of carriage 58, at one end, and at frame 22 by means of the intermediate piece 46, at the other end. Since the pivot arm 42 is pivotable at frame 22 in a vertical plane as well, a condition permitted in the embodiment shown by the pin bearing including the bearing pin 56 and the bearing bore 50, the pivot arm 42 will adopt such a position that the weight of the second segment 18 is distributed evenly among both supports of the pivot arm 42 in accordance with the geometry of the second segment. Consequently the dimensions of frame 22 need only be so selected that the frame will be able to withstand the corresponding proportion of the weight of the second segment 18.

It follows from the above specification that the carrier structures of the two segments 16 and 18 of the gate wing 14 described are arranged only in the area of the edges or the gate opening or the edges of the gate wing, thus remaining outside of the range where the risk of becoming damaged is the greatest. Furthermore, both segments 16 and 18 are not interconnected in supporting manner along their edges facing each other so that no strong forces could be transmitted from one segment to the other in this area. This is not opposed by the fact that, for instance, along the lower edge of gate wing 14 the two panels 20 and 36 are interconnected, for instance, by an elastic strip 68 whose purpose it is to avoid an erroneous folding of the two panels 20 and 36 but which would not withstand any greater impact stress.

Figure 4:
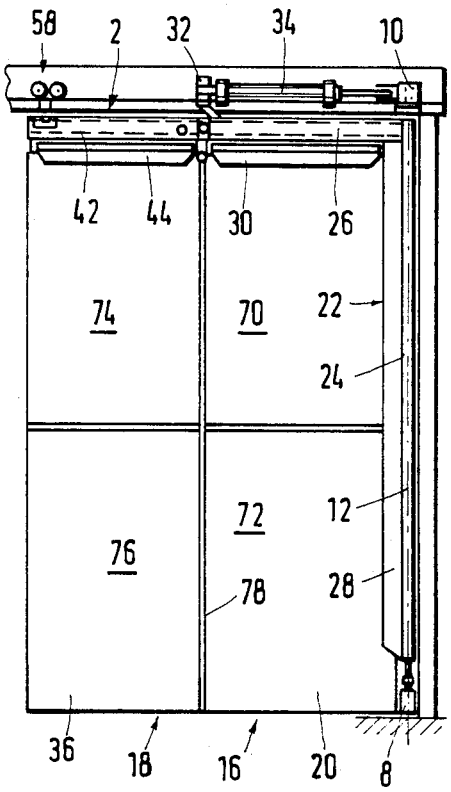
FIG. 4 is a front elevational view of a second embodiment of the folding gate according to the invention, showing only the right half thereof.

The embodiment shown in FIG. 4 largely agrees with the embodiment described above and shown in FIGS. 1 and 3. As the only difference resides in the design of the panels, the other members will not be described again. In the case of the embodiment according to FIG. 4 the panel 36 of the second segment 18 is made of two rigid rectangular boards 74 and 76 which are arranged one above the other, the lower board 76 being suspended from the upper board 74 which in turn is suspended from bar 44. As the respective suspensions are made to be non-rigid, the lower board 76, for example, any pivot with respect to the upper board 74 without, at the same time, moving the upper board 74.

In similar manner panel 20 of the first segment 16 is made of two rectangular, rigid boards 70 and 72 of which the upper one is secured to bars 30 and 28, while the lower board 72 is secured to bar 28 and also suspended from the upper board 70. Preferably boards 70 and 72 are fixed in such manner to bars 30 and 28 that the means of fixing them will break before the bars 28 and 30 or the frame 22 can be damaged by any shocks acting on boards 70 and 72.

The rigid boards 70, 72, 74, and 76 make it possible to use a folding gate consisting of two gate wings of the kind shown in FIG. 4 as an outside gate adapted to be locked by key or pawl means. If the door wings suffer damages, however, it will be possible at the same time to replace only the damaged board without having to exchange or rapair the corresponding segment, let alone both segments and their carrier structures.

Also with the embodiment shown in FIG. 4 the two segments 16 and 18 are interconnected in non-carrying fashion along their edges facing each other. Yet this does not exclude the possibility of having rigid connecting elements at that location, for example, weatherstripping 78 in the form of an elastic strip to seal the gap between the two panels 20 and 36.

It is obvious that the folding gate of the first embodiment, as shown in FIG. 1 as well as of the embodiment illustrated in FIG. 4 each is completed by a second wing (not shown). However, it is also possible to design folding gates which have one gate wing only which is composed of segments connected to one another.

It will be understood that while the invention has been shown and described in preferred form, changes may be made without departing from the scope of the invention as defined in the following claims.

What is claimed is:

1. A folding gate which is disposed in a gate opening comprising:

a substantially straight glide track arrangement means located at an upper limitation of the gate opening;

at least one gate wing pivotable about a vertical axis in a gate wing bearing, the gate wing comprising first and second rectangular segments, hinge means for movably connecting the segments, the first segment being supported directly by the gate wing bearing, the second segment carrying a first glide roller means at an end of an upper edge remote from the first segment, the first glide roller means being guided horizontally by the glide track arrangement means;

the first and second segments each including a panel and a carrier structure means for supporting the weight of the panel and to maintain the segments in associated bearings, the carrier structure means of the second segment comprising pivot arm means disposed at the upper edge of the second segment for suspending the second segment therefrom, the pivot arm means being connected at one end to the carrier structure means of the first segment for movement about a vertical axis and for a limited extent movement about a horizontal axis with respect to the first segment, another end of the pivot arm means carrying the first guide roller means and supported by the glide track arrangement means; the movement between the one end of the pivot arm means and the carrier structure means of the first segment is established by an intermediate piece including two pin bearings, one bearing pin extending in a vertical direction while the other bearing pin extends in a horizontal direction and the one pin bearing supporting the intermediate piece at the carrier structure means of the first segment while the other pin bearing supports the pivot arm means;

and a carriage means traversing the glide track arrangement means, the other end of the pivot arm means being in supportive suspension from the carriage means for tilting the carriage means in any desired direction with respect to the pivot arm means.

2. The folding gate as claimed in claim 1, wherein the panel of the second segment is movably suspended from the pivot arm means.

3. The folding gate as claimed in claim 1 or 2 wherein the carrier structure of the first segment comprises a rigid L-shaped frame one leg of which extends vertically along or parallel to the axis of the gate wing bearing and the other leg of which extends horizontally along the upper edge of the first segment and is movably connected at its free end to the one end of the pivot arm means.

4. The folding gate as claimed in claim 1, wherein the pin bearing which includes the vertical bearing pin connects the carrier structure means of the first segment to the intermediate piece.

5. The folding gate as claimed in claim 1 wherein the pivot arm carrier is suspended from the carriage means by means of a bar on which the first guide roller means is supported for rotation.

6. The folding gate as claimed in one of claims 1 or 2 wherein the panel is a web of flexible material.

7. The folding gate as claimed in one of claims 1 or 2 wherein the panel consists of at least one rigid board.

8. The folding gate as claimed in claim 7 wherein the panel consists of two rigid boards disposed one above the other, the lower board being suspended from the upper one.

9. The folding gate as claimed in claim 8 wherein individual or all gaps between adjacent boards of the segments and between boards and an adjacent carrier structure are closed by weatherstripping.

10. The folding gate according to claim 1 wherein the carriage means guides the first guide roller means in the glide track arrangement means;

and a plurality of second guide roller means, guided horizontally by the glide track arrangement means, the second guide roller means being connected in an articulated manner to the other end of the pivot arm means.

11. The folding gate according to claim 1 wherein the first and second segments are in partial overlapping relationship.

12. The folding gate according to claim 1 wherein the first and second segments are interconnected by an elastic strap.

* * * * *